US010605243B2

(12) United States Patent
Akei et al.

(10) Patent No.: US 10,605,243 B2
(45) Date of Patent: Mar. 31, 2020

(54) SCROLL COMPRESSOR WITH OIL MANAGEMENT SYSTEM

(71) Applicant: Emerson Climate Technologies, Inc., Sidney, OH (US)

(72) Inventors: Masao Akei, Cicero, NY (US); Roy J. Doepker, Lima, OH (US); Guangyong Zhou, Suzhou (CN); Qingfeng Sun, Suzhou (CN); Hongfei Shu, Suzhou (CN)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 16/047,675

(22) Filed: Jul. 27, 2018

(65) Prior Publication Data

US 2018/0335036 A1 Nov. 22, 2018

Related U.S. Application Data

(62) Division of application No. 14/413,204, filed as application No. PCT/CN2014/080951 on Jun. 27, 2014, now Pat. No. 10,036,388.

(Continued)

(51) Int. Cl.
*F04C 29/02* (2006.01)
*F04C 18/02* (2006.01)

(Continued)

(52) U.S. Cl.
CPC ..... *F04C 29/028* (2013.01); *F04C 18/0207* (2013.01); *F04C 18/0215* (2013.01);

(Continued)

(58) Field of Classification Search
CPC .... F04C 29/028; F04C 29/023; F04C 27/009; F04C 18/0207; F04C 18/0292;

(Continued)

(56) References Cited

U.S. PATENT DOCUMENTS 4,596,521 A 6/1986 Murayama et al.
4,669,962 A 6/1987 Mizuno et al.

(Continued)

FOREIGN PATENT DOCUMENTS

CN 1215806 A 5/1999
CN 1533480 A 9/2004

(Continued)

OTHER PUBLICATIONS

International Search Report regarding International Application No. PCT/CN2014/08095, dated Sep. 29, 2014.

(Continued)

*Primary Examiner* — Patrick Hamo
*Assistant Examiner* — Wesley G Harris
(74) *Attorney, Agent, or Firm* — Harness, Dickey & Pierce, P.L.C.

(57) ABSTRACT

A compressor is provided and may include a shell, a main bearing housing disposed within the shell, a driveshaft, a non-orbiting scroll member, and an orbiting scroll member. The driveshaft may be supported by the main bearing housing. The non-orbiting scroll member may be coupled to the main bearing housing and may include a first lubricant supply path in fluid communication with a lubricant source. The orbiting scroll member may be rotatably coupled to the driveshaft and may be meshingly engaged with the non-orbiting scroll member. The orbiting scroll member may include a recess that is moved between a first position in fluid communication with the first lubricant supply path and a second position fluidly isolated from the first lubricant supply path.

20 Claims, 8 Drawing Sheets

Related U.S. Application Data

(60) Provisional application No. 61/840,153, filed on Jun. 27, 2013.

(51) Int. Cl.
*F04C 27/00* (2006.01)
*F04C 23/00* (2006.01)

(52) U.S. Cl.
CPC ..... *F04C 18/0253* (2013.01); *F04C 18/0292* (2013.01); *F04C 23/008* (2013.01); *F04C 27/009* (2013.01); *F04C 29/023* (2013.01); *F04C 2240/806* (2013.01)

(58) Field of Classification Search
CPC ..... F04C 18/0253; F04C 18/0215; F04C 23/008; F04C 2240/806
USPC ..... 418/55.6
See application file for complete search history.

(56) References Cited

U.S. PATENT DOCUMENTS

| | | | | |
|---|---|---|---|---|
| 4,743,181 | A * | 5/1988 | Murayama | F04C 23/008 418/55.4 |
| 4,877,382 | A | 10/1989 | Caillat et al. | |
| 5,102,316 | A | 4/1992 | Caillat et al. | |
| 5,176,506 | A | 1/1993 | Siebel | |
| 5,263,822 | A | 11/1993 | Fujio | |
| 5,320,506 | A | 6/1994 | Fogt | |
| 5,379,516 | A | 1/1995 | Vaccaro et al. | |
| 5,395,224 | A | 3/1995 | Caillat et al. | |
| 5,803,722 | A | 9/1998 | Noboru et al. | |
| 5,810,573 | A | 9/1998 | Mitsunaga et al. | |
| 6,071,100 | A | 6/2000 | Yamada et al. | |
| 6,074,186 | A * | 6/2000 | Lifson | F04C 29/028 418/55.6 |
| 6,273,691 | B1 | 8/2001 | Morimoto et al. | |
| 6,375,444 | B1 | 4/2002 | Dewar | |
| 6,422,843 | B1 | 7/2002 | Sun et al. | |
| 6,533,561 | B1 | 3/2003 | Furusho et al. | |
| 6,893,235 | B2 | 5/2005 | Furusho et al. | |
| 6,932,586 | B2 * | 8/2005 | Furusho | F04C 18/0215 418/55.4 |
| 7,322,809 | B2 | 1/2008 | Kitaura et al. | |
| 7,458,789 | B2 | 12/2008 | Hiwata et al. | |
| 7,614,859 | B2 | 11/2009 | Sawai et al. | |
| 7,699,591 | B2 | 4/2010 | Futagami et al. | |
| 7,837,452 | B2 | 11/2010 | Ignatiev et al. | |
| 8,070,465 | B2 | 12/2011 | Ginies et al. | |
| 8,303,280 | B2 | 11/2012 | Kiyokawa et al. | |
| 8,348,647 | B2 | 1/2013 | Kiyokawa et al. | |
| 8,585,381 | B2 | 11/2013 | Kiyokawa et al. | |
| 8,992,191 | B2 | 3/2015 | Ahn et al. | |
| 9,133,843 | B2 | 9/2015 | Tsuka et al. | |
| 9,181,945 | B2 * | 11/2015 | Takeda | F04C 29/028 |
| 9,316,225 | B2 | 4/2016 | Nagahara et al. | |
| 9,759,216 | B2 * | 9/2017 | Kato | F04C 29/02 |
| 2002/0136652 | A1 | 9/2002 | Gennami et al. | |
| 2003/0063983 | A1 | 4/2003 | Ancel et al. | |
| 2004/0247474 | A1 | 12/2004 | Kitaura et al. | |
| 2004/0265159 | A1 | 12/2004 | Furusho et al. | |
| 2006/0006598 | A1 | 1/2006 | Kimura et al. | |
| 2007/0092390 | A1 | 4/2007 | Ignatiev et al. | |
| 2009/0162231 | A1 | 6/2009 | Liang et al. | |
| 2010/0212352 | A1 | 8/2010 | Kim et al. | |
| 2011/0011123 | A1 | 1/2011 | Matsuura et al. | |
| 2012/0258004 | A1 | 10/2012 | Ignatiev et al. | |
| 2013/0189080 | A1 | 7/2013 | Nakai et al. | |
| 2014/0017108 | A1 | 1/2014 | Uekawa et al. | |
| 2014/0248169 | A1 | 9/2014 | Uekawa | |
| 2015/0030487 | A1 | 1/2015 | Toyama et al. | |
| 2016/0187173 | A1 | 6/2016 | Jang et al. | |
| 2017/0051742 | A1 | 2/2017 | Tang et al. | |
| 2017/0146265 | A1 | 5/2017 | Fujitaka et al. | |
| 2018/0080448 | A1 | 3/2018 | Ma et al. | |

FOREIGN PATENT DOCUMENTS

| | | | |
|---|---|---|---|
| CN | 101663485 | A | 3/2010 |
| CN | 102454603 | A | 5/2012 |
| CN | 202250844 | U | 5/2012 |
| CN | 202250848 | U | 5/2012 |
| CN | 202266436 | U | 6/2012 |
| CN | 202597102 | U | 12/2012 |
| CN | 204126898 | U | 1/2015 |
| CN | 204646671 | U | 9/2015 |
| JP | H03105092 | A | 5/1991 |
| JP | H03237287 | A | 10/1991 |
| JP | H11247772 | A | 9/1999 |
| JP | H11247780 | A | 9/1999 |
| JP | 2001234879 | A | 8/2001 |
| JP | 2001234880 | A | 8/2001 |
| JP | 2011052576 | A | 3/2011 |
| JP | 2012215174 | A | 11/2012 |
| WO | WO-2012132436 | A1 | 10/2012 |

OTHER PUBLICATIONS

Written Opinion of the International Searching Authority regarding International Application No. PCT/CN2014/08095, dated Sep. 29, 2014.

Office Action regarding Chinese Patent Application No. 201410302694.4, dated Dec. 31, 2015. Translation provided by Unitalen Attorneys at Law.

Office Action regarding Chinese Patent Application No. 201410302694.4, dated Sep. 5, 2016. Translation provided by Unitalen Attorneys at Law.

Restriction Requirement regarding U.S. Appl. No. 14/413,204, dated Aug. 25, 2017.

Office Action regarding U.S. Appl. No. 14/413,204, dated Nov. 29, 2017.

Interview Summary regarding U.S. Appl. No. 14/413,204, dated Jan. 23, 2018.

Notice of Allowance regarding U.S. Appl. No. 14/413,204 dated Jun. 19, 2018.

International Search Report regarding International Application No. PCT/CN2016/074823, dated May 27, 2016.

Written Opinion of the International Searching Authority regarding International Application No. PCT/CN2016/074823, dated May 27, 2016.

Office Action regarding Chinese Patent Application No. 201510216987.5, dated Dec. 5, 2017. Translation provided by Unitalen Attorneys at Law.

* cited by examiner

SCROLL COMPRESSOR WITH OIL MANAGEMENT SYSTEM

CROSS-REFERENCE TO RELATED APPLICATIONS

This application is a division of U.S. patent application Ser. No. 14/413,204 filed on Jan. 6, 2015, which is a National Stage of International Application No. PCT/CN2014/080951, filed on Jun. 27, 2014, which claims the benefit of U.S. Provisional Application No. 61/840,153, filed on Jun. 27, 2013. The entire disclosures of each of the above applications are incorporated herein by reference.

FIELD

The present disclosure relates to an oil-management system for a scroll compressor.

BACKGROUND

This section provides background information related to the present disclosure which is not necessarily prior art.

Scroll compressors are used in applications such as refrigeration systems, air conditioning systems, and heat pump systems to pressurize and, thus, circulate refrigerant within each system.

As the scroll compressor operates, an orbiting scroll member having an orbiting scroll member wrap orbits with respect to a non-orbiting scroll member having a non-orbiting scroll member wrap to make moving line contacts between flanks of the respective scroll wraps. In so doing, the orbiting scroll member and the non-orbiting scroll member cooperate to define moving, crescent-shaped pockets of vapor refrigerant. A volume of the fluid pockets decreases as the pockets move toward a center of the scroll members, thereby compressing the vapor refrigerant disposed therein from a suction pressure to a discharge pressure.

During operation, lubrication is provided to many of the moving components of the scroll compressor in an effort to reduce wear, improve performance, and, in some instances, to cool one or more components. For example, lubrication in the form of oil may be provided to the orbiting scroll member and to the non-orbiting scroll member such that flanks of the orbiting scroll spiral wrap and flanks of the fixed scroll spiral wrap are lubricated during operation. Such lubrication may be returned to a sump of the compressor and in so doing may come in contact with a motor of the compressor, thereby cooling the motor to a desired temperature.

While lubrication is typically used in a scroll compressor to improve performance and longevity, such lubrication is typically separated from vapor refrigerant located within the compressor to improve compressor performance and efficiency.

SUMMARY

This section provides a general summary of the disclosure, and is not a comprehensive disclosure of its full scope or all of its features.

A compressor is provided and may include a shell, a main bearing housing disposed within the shell, a driveshaft, a non-orbiting scroll member, and an orbiting scroll member. The driveshaft may be supported by the main bearing housing. The non-orbiting scroll member may be coupled to the main bearing housing and may include a first lubricant supply path in fluid communication with a lubricant source. The orbiting scroll member may be rotatably coupled to the driveshaft and may be meshingly engaged with the non-orbiting scroll member. The orbiting scroll member may include a recess that is moved between a first position in fluid communication with the first lubricant supply path and a second position fluidly isolated from the first lubricant supply path.

In another configuration, a compressor is provided and may include a shell, a main bearing housing disposed within the shell, a driveshaft, a non-orbiting scroll member, and an orbiting scroll member. The driveshaft may be supported by the main bearing housing. The non-orbiting scroll member may be coupled to the main bearing housing and may include a first surface defining a first lubricant recess. The orbiting scroll member may be rotatably coupled to the driveshaft and may be meshingly engaged with the non-orbiting scroll member. The orbiting scroll member may include a second lubricant recess in fluid communication with a lubricant source and movable between a first position in fluid communication with the first lubricant recess and a second position fluidly isolated from the first lubricant recess.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
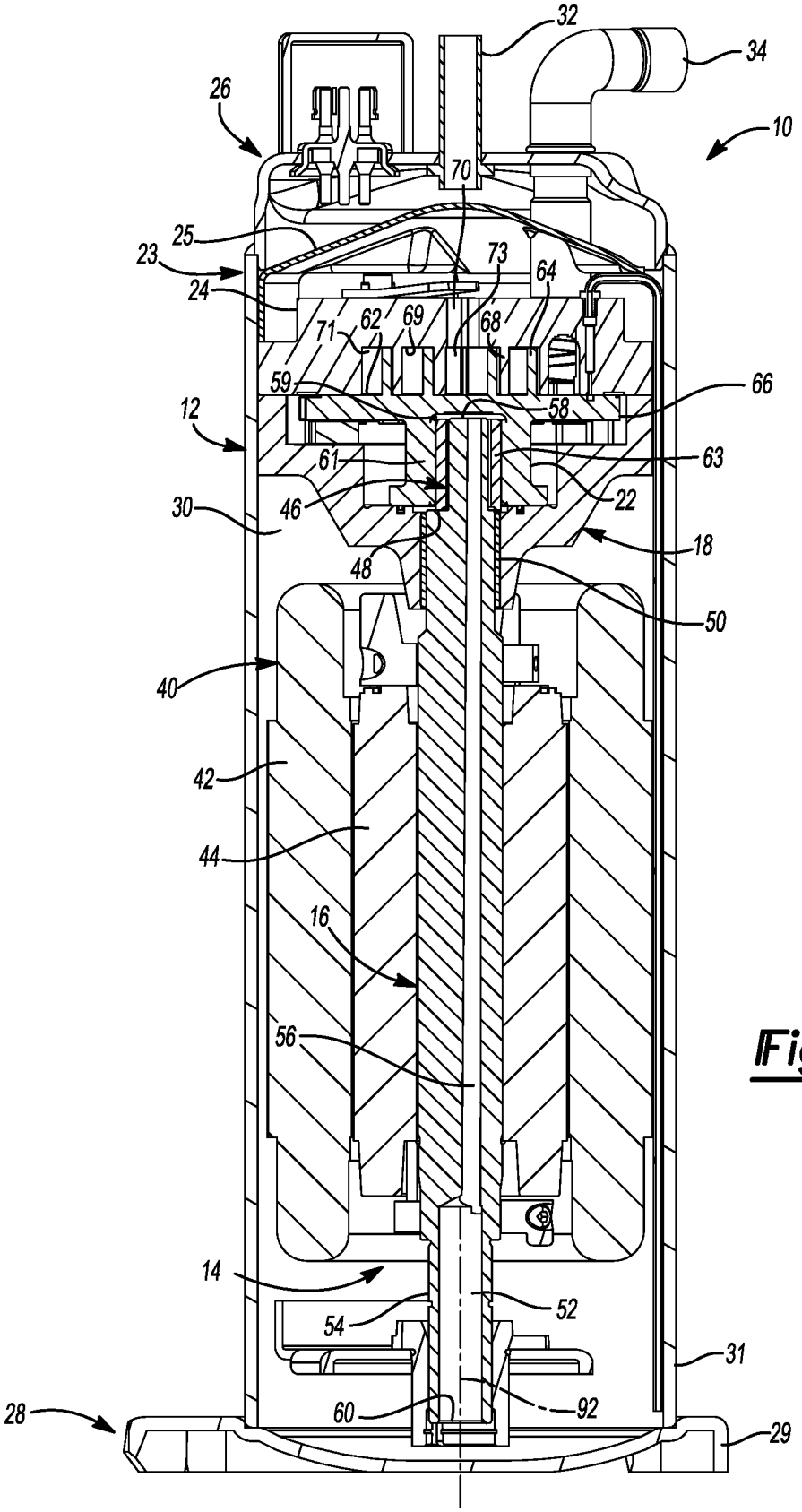
FIG. 1 is a cross-sectional view of a compressor in accordance with the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to the Figures, a compressor 10 is shown to include a generally cylindrical hermetic shell 12, a motor 14, a driveshaft 16, a main bearing housing 18, an orbiting scroll member 22, a non-orbiting scroll member 24, a separation baffle 25, and a lubrication system 27.

The hermetic shell 12 includes a welded cap 26 at a top portion 23, and a base 28 having a plurality of feet 29 welded at a bottom portion 31. The cap 26 and the base 28 are fitted to the shell 12 such that an interior volume 30 of the compressor 10 is defined. Lubricant may be stored within the bottom portion 31 of the hermetic shell 12 for lubricating the moving parts of the compressor 10, as will be described below. The cap 26 is provided with a discharge fitting 32 in fluid communication with the interior volume 30 of the compressor 10 and an inlet fitting 34 in fluid communication with the exterior of the compressor 10. An electrical enclosure, such as a plastic cover (not shown), may be attached to the cap 26 and may support a portion of an electrical protection and control system (not shown) therein.

The driveshaft 16 is rotatably driven by the motor 14 relative to the shell 12. The motor 14 includes a stator 40 fixedly supported by the hermetic shell 12, windings 42 passing therethrough, and a rotor 44 press-fit on the driveshaft 16. The motor 14 and associated stator 40, windings 42, and rotor 44 cooperate to drive the driveshaft 16 relative to the shell 12 to compress a fluid.

The driveshaft 16 may include an eccentric pin 46 mounted to, or integrally formed with, a first end 48 thereof. A portion of the driveshaft 16 is supported by a main bearing 50 provided in the main bearing housing 18. The driveshaft 16 may include a central bore 52 formed at a lower end 54 thereof and an eccentric bore 56 extending upwardly from the central bore 52 to an end surface 58 of the eccentric pin 46. An end portion 60 of the central bore 52 may be immersed in the lubricant at the bottom portion 31 of the hermetic shell 12 of the compressor 10 (FIG. 1), such that lubricant can be pumped from the bottom portion 31, and up through the end surface 58 of the eccentric pin 46.

Under the action of the centrifugal force generated by the rotation of the driveshaft 16, the lubricant may traverse the central bore 52 from the end portion 60 to the end surface 58 of the eccentric pin 46. Lubricant exiting the end surface 58 of the eccentric pin 46 may create a lubricant supply area 59 between the eccentric pin 46 and the orbiting scroll member 22 and between the main bearing housing 18 and the orbiting scroll member 22, lubricating the rotational joints and sliding surfaces therebetween. As will be described below, the lubricant supply area 59 may also supply lubricant to the lubrication system 27.

The orbiting scroll member 22 may be disposed within, and axially supported by, the main bearing housing 18. An inner hub 61 of the orbiting scroll member 22 may be rotatably coupled to the eccentric pin 46. Alternatively, the inner hub 61 may be rotatably coupled to the eccentric pin 46 via a bushing or bearing 63. An upper surface 62 of the orbiting scroll member 22 includes a spiral vane or wrap 64 for use in receiving and compressing a fluid received through the inlet fitting 34. An Oldham coupling 66 is disposed generally between the orbiting scroll member 22 and the main bearing housing 18 and is keyed to the orbiting scroll member 22 and the non-orbiting scroll member 24. The Oldham coupling 66 restricts rotational motion between the non-orbiting scroll member 24 and the orbiting scroll member 22. The Oldham coupling 66, and its interaction with the orbiting scroll member 22 and non-orbiting scroll member 24, is preferably of the type disclosed in assignee's commonly owned U.S. Pat. No. 5,320,506, the disclosure of which is incorporated herein by reference.

The non-orbiting scroll member 24 also includes a wrap 68 extending from a lower surface 69 thereof, and positioned in meshing engagement with the wrap 64 of the orbiting scroll member 22. As the compressor 10 operates, the wrap 68 of the non-orbiting scroll member 24 and the wrap 64 of the orbiting scroll member 22 define moving, isolated crescent-shaped pockets of fluid. The fluid pockets carry the fluid to be handled from a low-pressure zone 71, in fluid communication with the inlet fitting 34, to a high-pressure zone 73, in fluid communication a centrally disposed discharge passage 70 provided in the non-orbiting scroll member 24. The discharge passage 70 fluidly communicates with the interior volume 30 of the compressor 10, such that compressed fluid exits the shell 12 via the discharge passage 70 and discharge fitting 32. The non-orbiting scroll member 24 is designed to be mounted to the main bearing housing 18 using mechanical fasteners (not shown) such as threaded fasteners, bolts, screws, or a similar fastening device.

Figure 2:
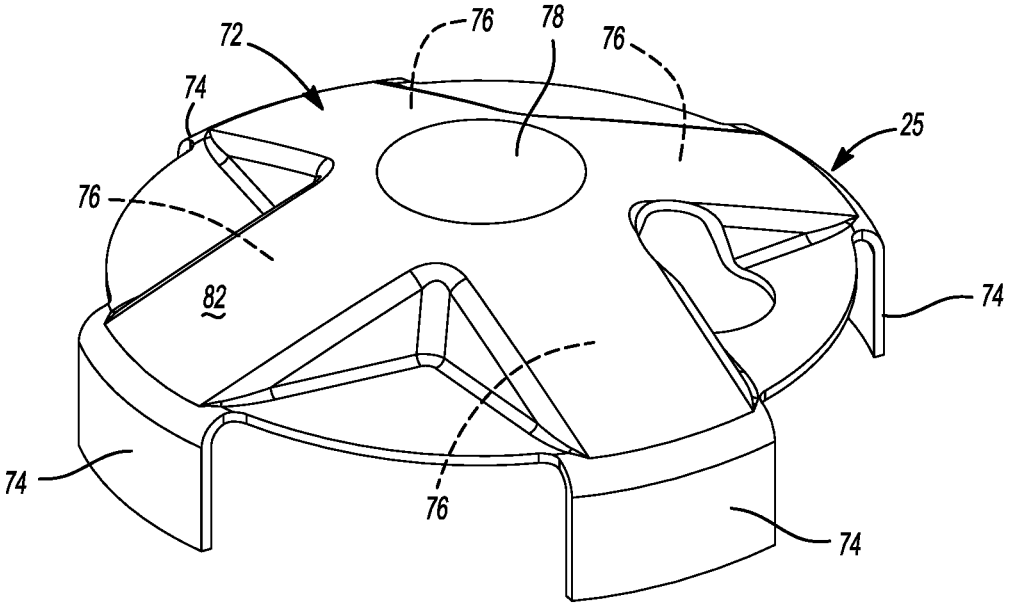
FIG. 2 is a top perspective view of a separation baffle of the compressor of FIG. 1.
Figure 3:
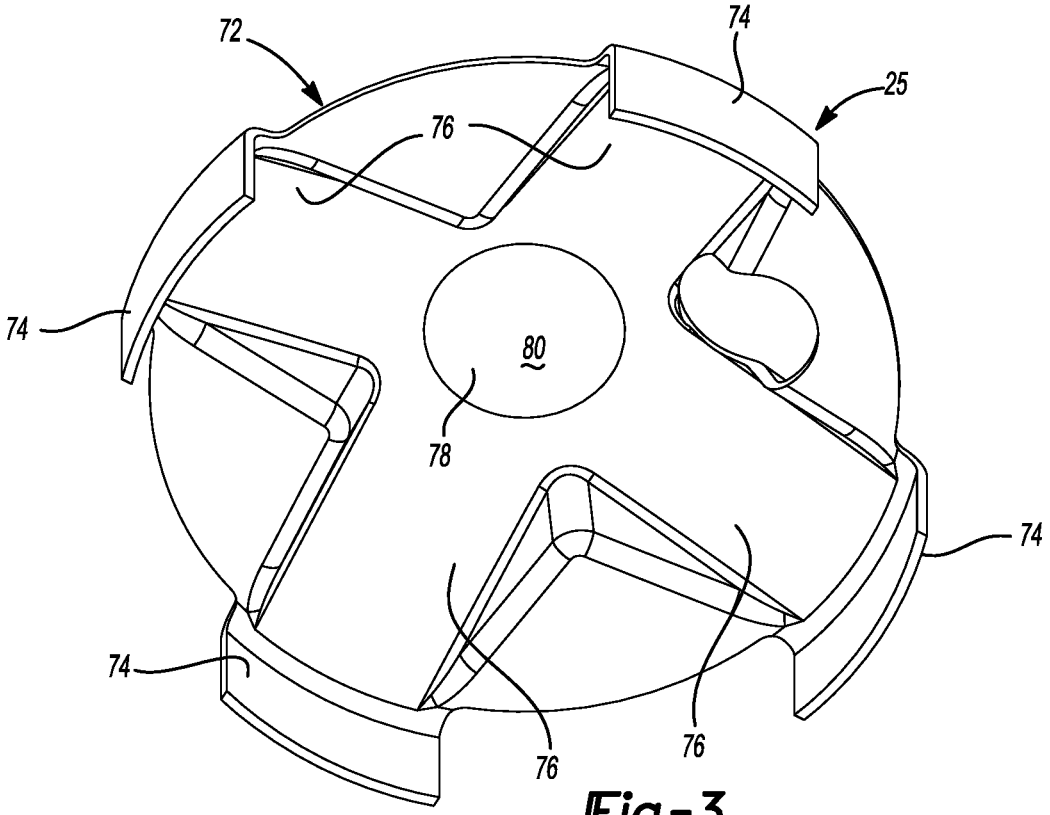
FIG. 3 is a bottom perspective view of the separation baffle of FIG. 2.

With reference to FIGS. 1 through 3, the separation baffle 25 is shown as being coupled to the non-orbiting scroll member 24 and as including a cover portion 72 and a plurality of vertical support members 74. A plurality of channels 76 may extend angularly from the vertical support members 74 to a peak 78 of the cover portion 72. The plurality of channels 76 may cooperate with the vertical support members 74 to facilitate the flow of (i) the compressed fluid from the discharge passage 70 to the discharge fitting 32, and (ii) lubricant from the discharge passage 70 to the bottom portion 31 of the hermetic shell 12. Specifically, as the compressed fluid and lubricant exit the discharge passage 70, they contact a lower surface 80 of the peak 78 of the cover portion 72. From the peak 78, the compressed fluid and lubricant flow down the plurality of channels 76 and contact the vertical support members 74. The compressed fluid is forced to each side of the vertical support members 74, where it flows back to the peak 78 of the cover portion 72, along an upper surface 82 thereof, prior to exiting the compressor 10 through the discharge fitting 32. The lubricant, due to the weight thereof, flows down the vertical support members 74 upon contact, through the interior volume 30 of the compressor 10 and back to the bottom portion 31 of the hermetic shell 12, where the lubrication cycle (described in more detail below) begins again.

Figure 5:
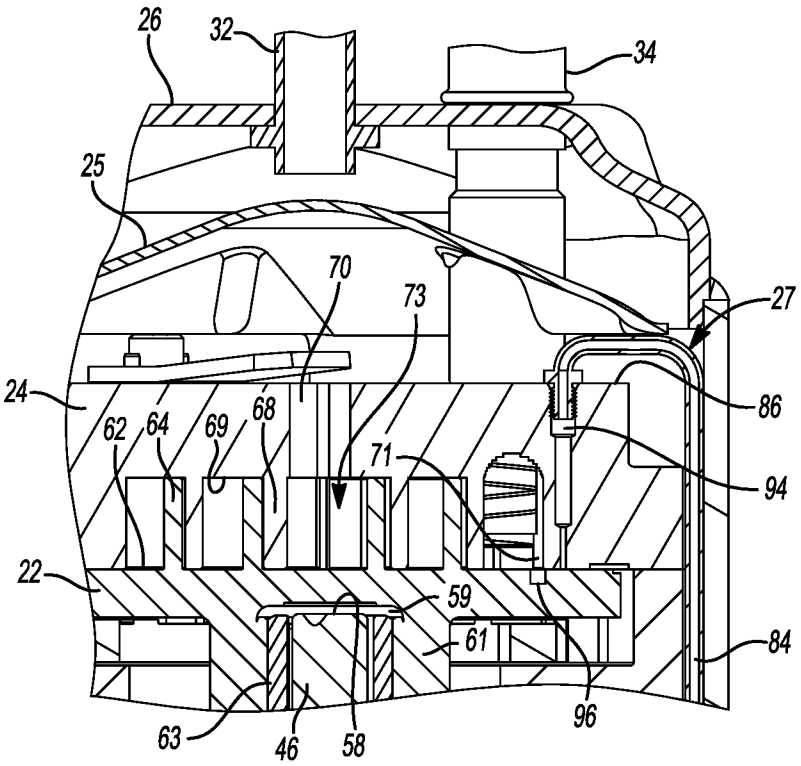
FIG. 5 is a partial cross-sectional view of the compressor of FIG. 1, showing the oil management system of FIG. 4 in a second orientation.
Figure 4:
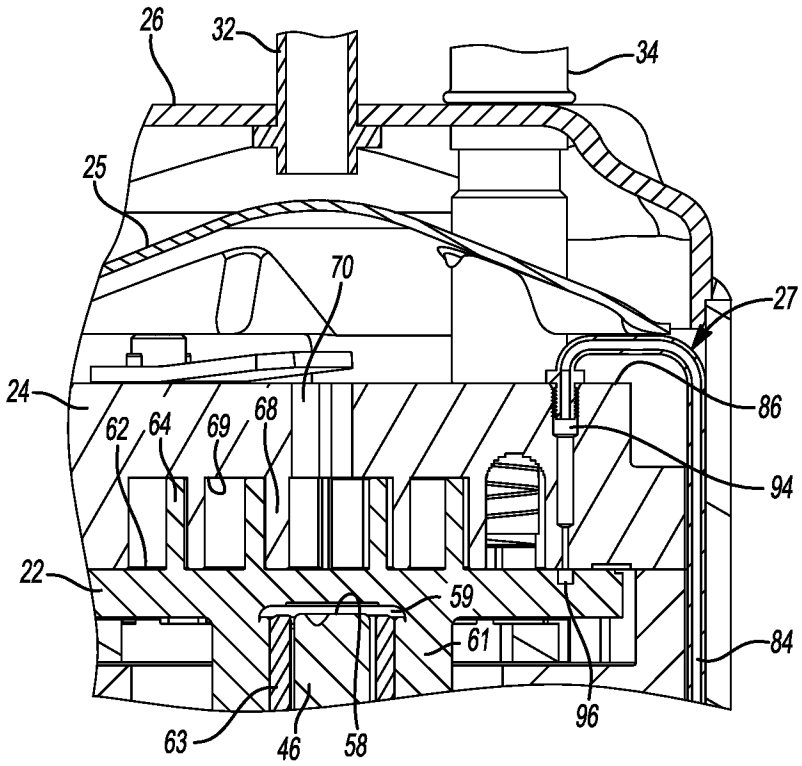
FIG. 4 is a partial cross-sectional view of the compressor of FIG. 1, showing an oil management system in a first orientation.

With reference to FIGS. 4 and 5, in a first configuration of the lubrication system 27, a lubricant supply tube 84 may extend from the bottom portion 31 of the hermetic shell 12 to an upper surface 86 of the non-orbiting scroll member 24. The lubricant supply tube 84 may extend through a slot, groove, aperture, or similar passageway traversing each of the main bearing housing 18 and the non-orbiting scroll member 24, in a direction substantially parallel to a rotational axis 92 of the driveshaft. The non-orbiting scroll member 24 may include a bore 94 in fluid communication with the lubrication supply tube 84 and extending from the upper surface 86 through the non-orbiting scroll member 24.

The upper surface 62 of the orbiting scroll member 22 may include a counter bore or recess 96. The recess 96 may intermittently fluidly communicate with the bore 94. Specifically, and with reference to FIG. 4, during operation of the compressor 10, pressure, created by the compressed fluid exiting the discharge passage 70 and filling the interior volume 30 of the compressor 10, forces the lubricant through the lubricant supply tube 84 and the bore 94. As the orbiting scroll member 22 orbits about the rotational axis 92 of the driveshaft 16, the bore 94 will be in intermittent fluid communication with the recess 96, thereby allowing the high-pressure lubricant disposed within the lubricant supply tube 84 and bore 94 to exit the non-orbiting scroll member 24 and enter the recess 96. Prior to the recess 96 communicating with the bore 94, the lubricant disposed within the lubricant supply tube 84 and bore 94 is prevented from exiting the non-orbiting scroll member 24, as the non-orbiting scroll member 24—in the area of the bore 94—is in contact with the orbiting scroll member 22, thereby sealing the bore 94, as will be described in greater detail below.

The recess 96 can be sized (for example, the diameter, width, depth, or other dimensions) such that a specific and pre-determined amount of lubricant is able to enter the recess 96 during each period of intermittent fluid communication with the bore 94. For example, the recess 96 may have a diameter of between 5 mm and 10 mm and a depth between 1 mm and 10 mm, such that the volume of the recess 96 (and therefore the volume of lubricant stored in the recess 96 during periods of intermittent fluid communication with the bore 94) is approximately 19 $mm^3$ to 785 $mm^3$.

With reference to FIG. 5, during intermittent periods of non-communication between the bore 94 and the recess 96 (i.e., when the bore 94 is not aligned with the recess 96), the bore 94 will be sealed by the upper surface 62 of the orbiting scroll member 22. In this position, the recess 96—and any lubricant disposed therein—is exposed to the low-pressure zone 71.

In this position, lubricant will exit the recess 96 and enter the low-pressure zone 71, where it will undergo the compression process created by the orbital movement of the wrap 64 relative to the wrap 68, prior to exiting the discharge passage 70 in the high-pressure zone 73. This process will repeat as the compressor 10 operates and the orbiting scroll member 22 orbits relative to the non-orbiting scroll member 24. In this manner, a specific amount of lubrication is provided between the wraps 64, 68 of the orbiting scroll member 22 and the non-orbiting scroll member 24 to reduce frictional forces, create sealing between the wrap 64 of the orbiting scroll member 22 and the wrap 68 of the non-orbiting scroll member 24, and dissipate any heat that is created by such frictional forces and/or the compression process.

Figure 7:
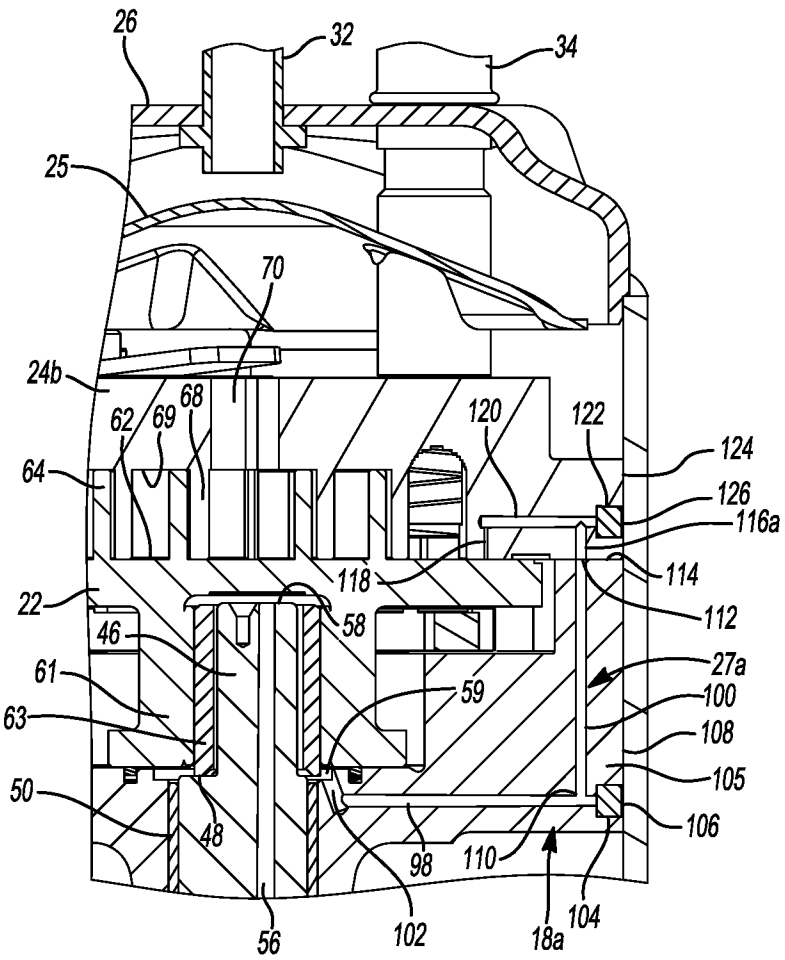
FIG. 7 is a partial cross-sectional view of the compressor of FIG. 1, showing another oil management system in accordance with the principles of the present disclosure.
Figure 6:
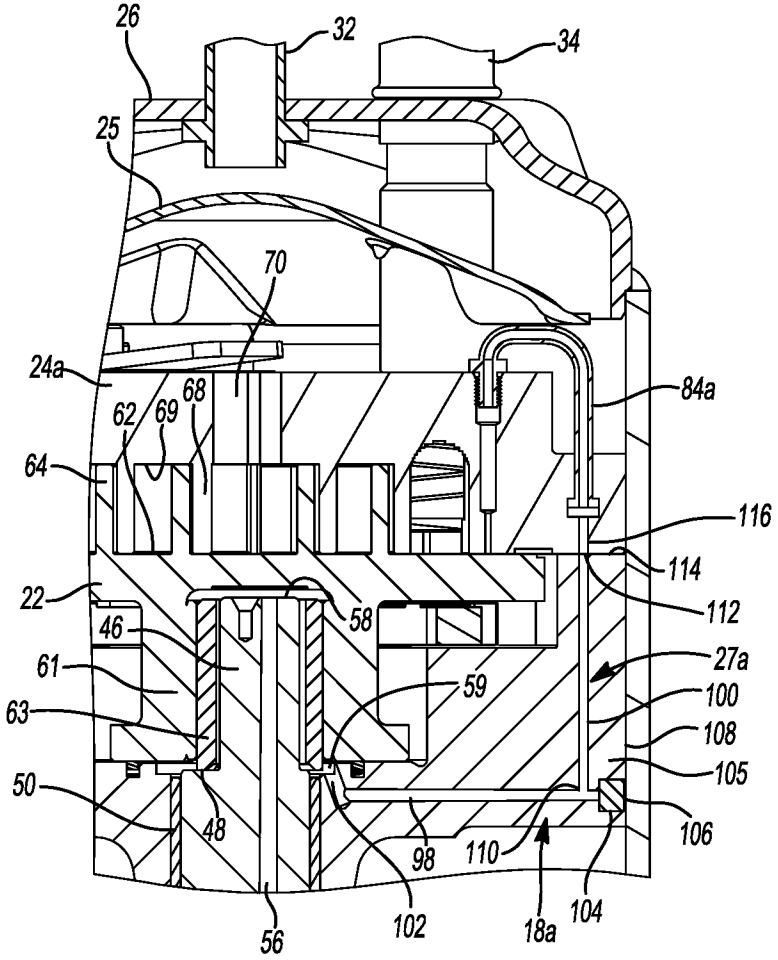
FIG. 6 is a partial cross-sectional view of the compressor of FIG. 1, showing another oil management system in accordance with the principles of the present disclosure.
Figure 9:
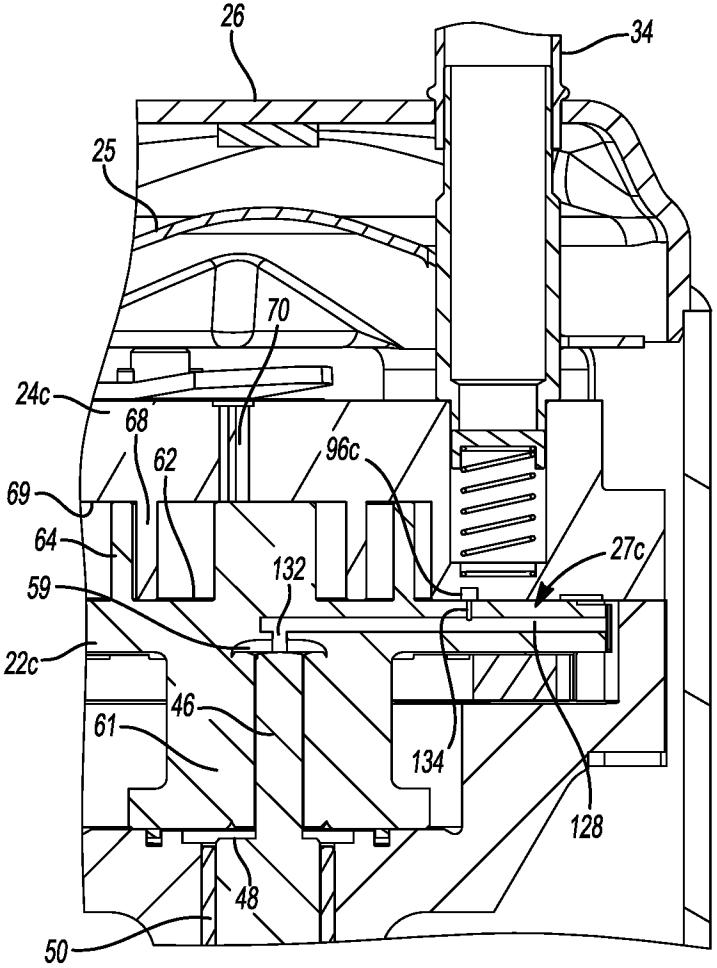
FIG. 9 is a partial cross-sectional view of the compressor of FIG. 1, showing the oil management system of FIG. 8 in a second orientation.
Figure 8:
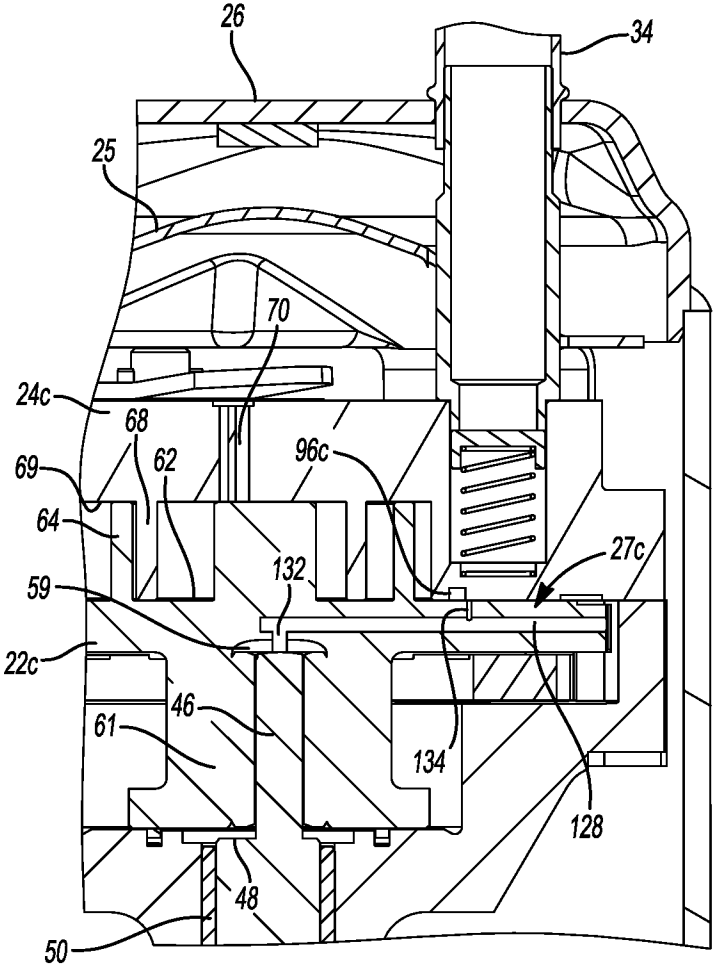
FIG. 8 is a partial cross-sectional view of the compressor of FIG. 1, showing another oil management system in accordance with the principles of the present disclosure, and in a first orientation.

With reference to FIGS. 6 and 7, another lubrication system **27*a* is provided for use with the compressor 10 and may include a first lubricant passageway 98 and a second lubricant passageway 100 associated with the main bearing housing 18. The lubrication system 27*a* is generally similar to the lubrication system 27**. Accordingly, like reference numerals are used hereinafter and in the drawings to identify like components while like reference numerals followed by a letter extension (i.e., an "a" or a "b") are used to identify those components that have been modified.

The first lubricant passageway 98 may be a bore having a first end 102 adjacent to the lubricant supply area 59, and a second end 104 in an outer wall 105 of the main bearing housing 18. The second end 104 may be sealed by a plug member 106, or by sealing engagement with an inner wall 108 of the hermetic shell 12. The first lubricant passageway 98 may extend in a radial direction, substantially perpendicular to the rotational axis 92 of the driveshaft 16. The second lubricant passageway 100 may be a bore having a first end 110 disposed adjacent to the first lubricant passageway 98, and a second end 112 terminating at an upper surface 114 of the main bearing housing 18. The second lubricant passageway 100 may extend in a direction substantially parallel to the rotational axis 92 of the driveshaft 16 or in a direction towards the non-orbiting scroll member 24*a*.

With reference to FIG. 6, the second end 112 of the second lubricant passageway 100 may be in fluid communication with the lubricant supply tube 84*a* traversing the non-orbiting scroll member 24*a* via a first bore 116 formed in the non-orbiting scroll member 24*a*. The lubricant supply tube 84*a* may intermittently fluidly communicate with the recess 96 (not shown) of the orbiting scroll member 22, similarly as described above with respect to the configuration shown in FIGS. 4 and 5.

With reference to FIG. 7, in an alternative arrangement of the second configuration, a non-orbiting scroll member 24*b* may include a first bore 116*a*, a second bore 118, and a third bore 120. The first bore 116*a* may be disposed adjacent to the second end 112 of the second lubricant passageway 100. The first bore 116*a* may extend in a direction substantially parallel to the rotational axis 92 of the driveshaft 16. The second bore 118 may extend from the lower surface 69 of the non-orbiting scroll member 24*b* and may intermittently fluidly communicate with the recess 96, as described above.

The third bore 120 may extend from an outer surface 124 of the non-orbiting scroll member 24*b* and may be in fluid communication with the first bore 116*a* and the second bore 118. The third bore 120 may extend in a radial direction, substantially perpendicular to the rotational axis 92 of the driveshaft 16. A first end 122 of the third bore 120 may be sealed by at least one of a plug member 126 or by sealing engagement with the inner wall 108 of the hermetic shell 12. In the second configuration, lubricant may be supplied by the central bore 52 of the driveshaft 16, thereby eliminating the need for a separate lubricant supply tube extending from the bottom portion 31 of the hermetic shell 12.

In the first and second arrangements of the lubrication system 27*a* (FIGS. 6 and 7), high-pressure lubricant may enter the first end 102 of the first lubricant passageway 98 from the lubricant supply area 59. The high pressure lubricant may traverse the lubricant passageways of the first and second configurations before filling the recess 96 (not shown) and providing lubrication to the wraps 64, 68, as described above.

With reference to FIG. 8-12, a third configuration of the lubrication system 27*c* is provided and may include a lubricant passageway 128 and a counter bore or lubricant recess 130 formed in the orbiting scroll member 22*c*. The lubrication system 27*c* is generally similar to the lubrication system 27. Accordingly, like reference numerals are used hereinafter and in the drawings to identify like components while like reference numerals followed by a letter extension (i.e., "c") are used to identify those components that have been modified.

The lower surface 69 of the non-orbiting scroll member 24*c* may include a counter bore or recess 96*c*. A first end 132 of the lubricant passageway 128 may be in fluid communication with the lubricant supply area 59 while a second end 134 of the lubricant passageway 128 may be in intermittent fluid communication with the recess 96*c*. As will be described below, the recess 96*c* may be in intermittent fluid communication with the lubricant recess 130. The recess 96*c* can be sized (for example, the diameter, width, depth, or other dimensions) such that a specific and pre-determined amount of lubricant is able to enter the recess 96*c* during each period of intermittent fluid communication with the lubricant passageway 128. For example, the recess 96*c* may have a diameter of between 5 mm and 10 mm and a depth between 1 mm and 10 mm, such that the volume of the recess 96*c* (and therefore the volume of lubricant stored in the recess 96*c* during periods of intermittent fluid communication with the lubricant passageway 128) is approximately 19 $mm^3$ to 785 $mm^3$.

Figure 10:
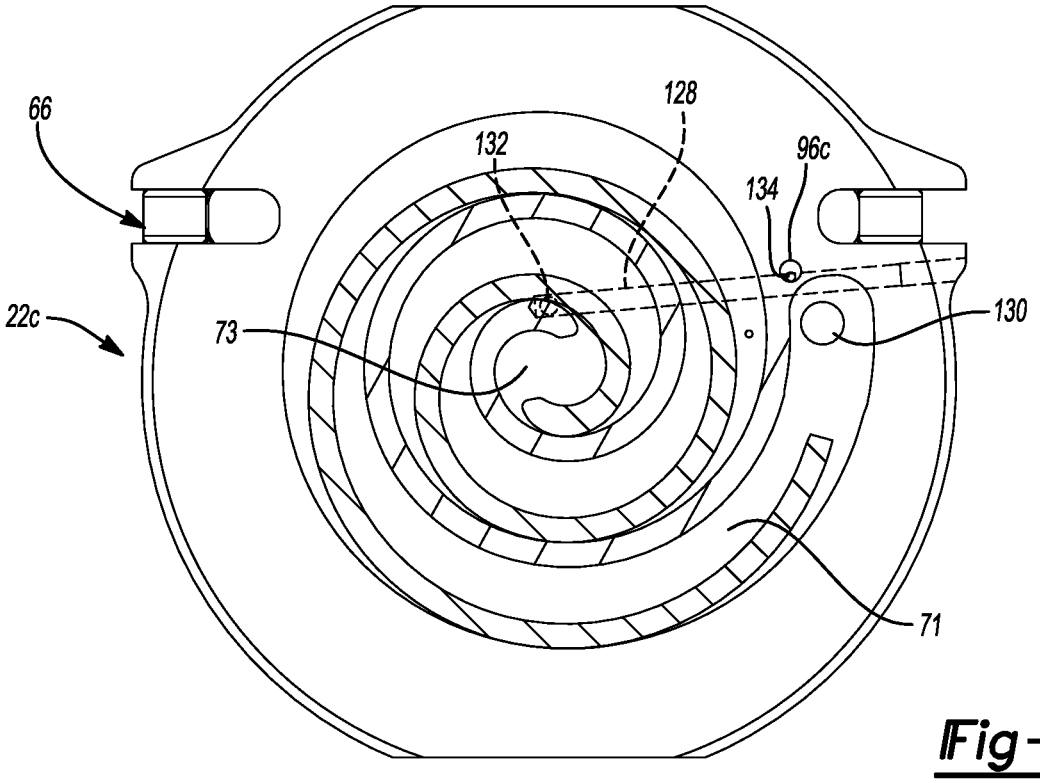
FIG. 10 is a top view of the oil management system of FIG. 8 in the first orientation.
Figure 11:
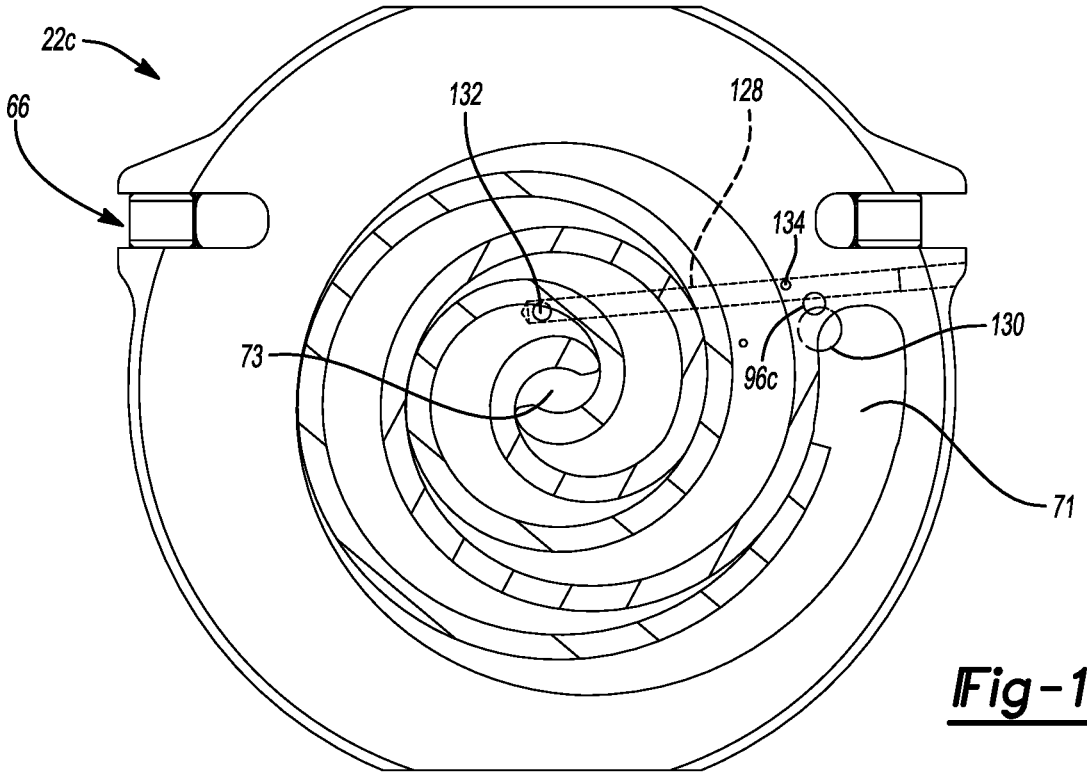
FIG. 11 is a top view of the oil management system of FIG. 8 in the second orientation.
Figure 12:
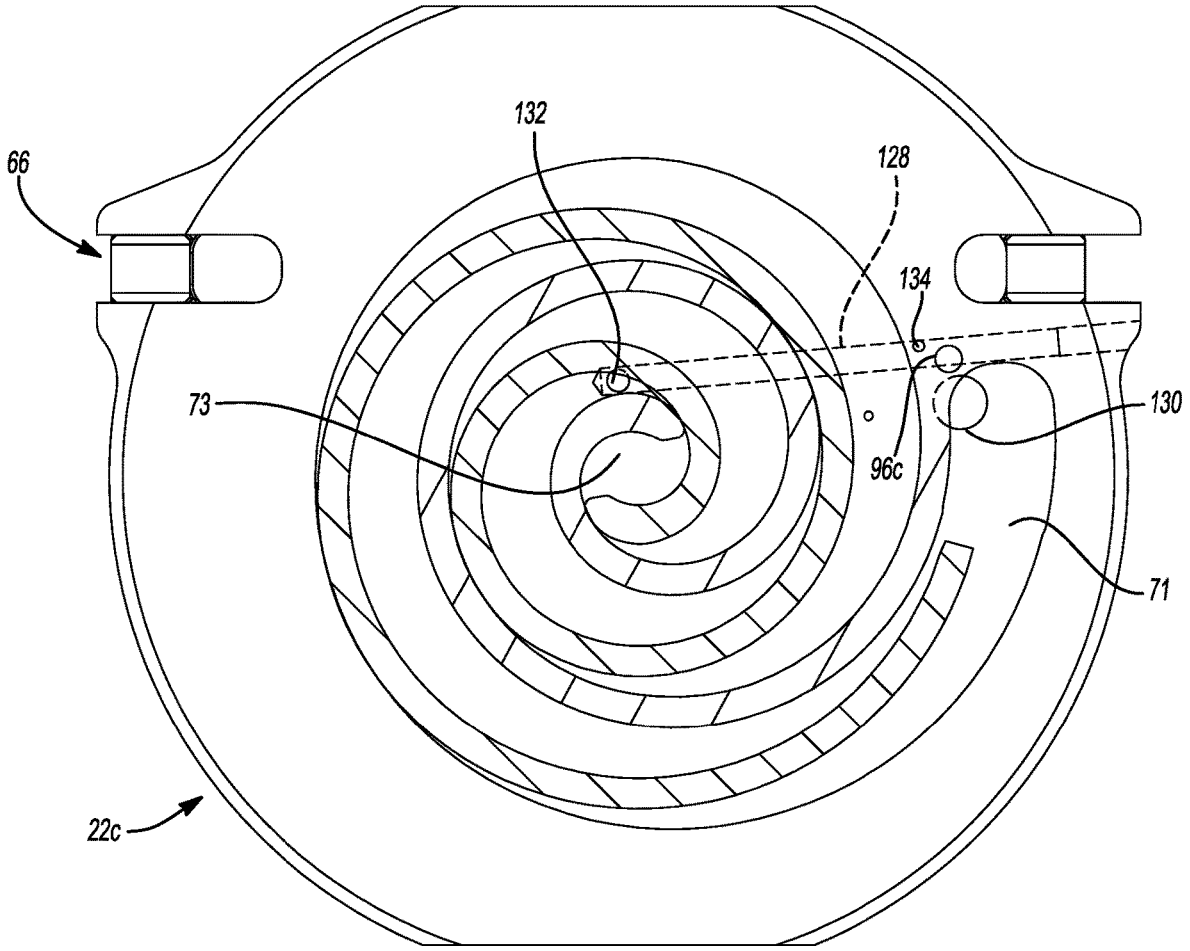
FIG. 12 is a top view of the oil management system of FIG. 8 in a third orientation.

With reference to FIGS. 10-12, in the third configuration of the lubrication system 27*c*, high-pressure lubricant may enter the first end 132 of the lubricant passageway 128 from the lubricant supply area 59. The high-pressure lubricant may traverse the lubricant passageway 128 before filling the recess 96*c* provided in the non-orbiting scroll member 24*c* (FIGS. 8 and 9), in the manner described above with respect to the recess 96 of the first configuration (FIGS. 4 and 5).

Upon further rotation of the driveshaft 16 (FIG. 11), and orbital movement of the orbiting scroll member 22*c*, the recess 96*c* and the high-pressure lubricant disposed therein may be exposed to the low-pressure lubricant recess 130 provided in the orbiting scroll member 22*c*. The high-pressure lubricant may exit the recess 96*c* and enter the lubricant recess 130.

Upon further rotation of the driveshaft 16 (FIG. 12), and orbital movement of the orbiting scroll member 22*c*, the high-pressure lubricant disposed in the lubricant recess 130 may be exposed to the low-pressure zone 71. The high-pressure lubricant may exit the lubricant recess 130 and enter the low-pressure zone 71 due to the pressure differential therebetween, where the lubricant will undergo the compression process created by the orbital movement of the wrap 64 relative to the wrap 68, and then exit the discharge passage 70 in the high-pressure zone 73. The foregoing process will repeat as the compressor 10 operates and the orbiting scroll member 22*c* orbits relative to the non-orbiting scroll member 24*c*. In this manner, a specific amount of lubrication is provided between the wraps 64, 68 of the orbiting scroll member 22*c* and non-orbiting scroll member 24*c* to reduce frictional forces and dissipate any heat that is created by such forces.

Figure 13:
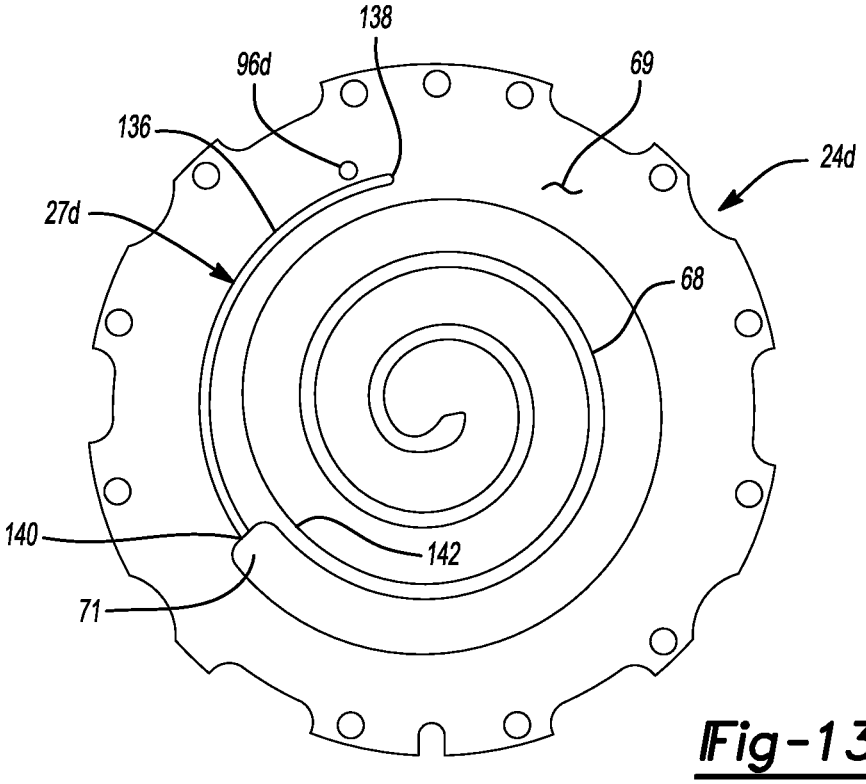
FIG. 13 is a top view of a lower surface of a non-orbiting scroll including another oil management system in accordance with the principles of the present disclosure.
Figure 14:
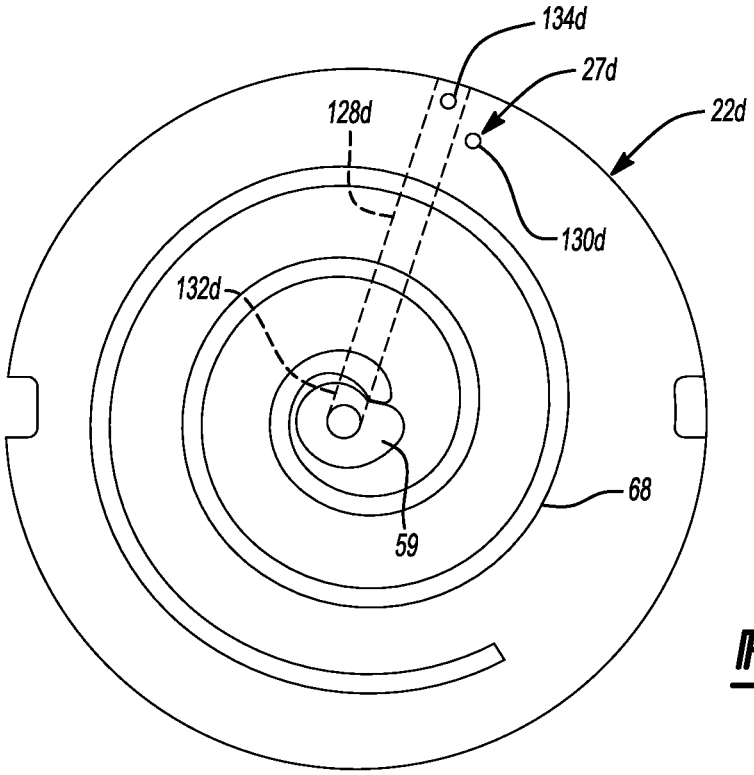
FIG. 14 is a top plan view of an upper surface of an orbiting scroll including the oil management system of FIG. 13.

With reference to FIGS. 13 and 14, a fourth configuration of the lubrication system 27*d* is provided and may include a lubricant passageway 128*d* and a counter bore or lubricant recess 130*d* formed in the orbiting scroll member 22*d*. The lubrication system 27*d* is generally similar to the lubrication system 27*c*. Accordingly, like reference numerals are used hereinafter and in the drawings to identify like components while like reference numerals followed by a letter extension (i.e., "d") are used to identify those components that have been modified.

The lower surface 69 of the non-orbiting scroll member 24*d* may include a counter bore or recess 96*d* and a groove or channel 136. As illustrated in FIG. 13, the channel 136 may extend arcuately from and between a first end 138 and a second end 140. The first end 138 may be adjacent or proximate the recess 96*d*. The second 140 may be adjacent or proximate an outer end 142 of the wrap 68. In an assembled configuration, the second end 140 may be in fluid communication with the low-pressure zone 71.

A first end 132*d* of the lubricant passageway 128*d* may be in fluid communication with the lubricant supply area 59 while a second end 134*d* of the lubricant passageway 128*d* may be in intermittent fluid communication with the recess 96*d*. Specifically, high-pressure lubricant may enter the first end 132*d* of the lubricant passageway 128*d* from the lubricant supply area 59. The high-pressure lubricant may traverse the lubricant passageway 128*d* before filling the recess 96*d* provided in the non-orbiting scroll member 24*d*, in the manner described above with respect to the recess 96*c* of the third configuration (FIGS. 8-12).

Upon further rotation of the driveshaft 16, and orbital movement of the orbiting scroll member 22*d*, the recess 96*d* and the high-pressure lubricant disposed therein may be exposed to the low-pressure lubricant recess 130*d* provided in the orbiting scroll member 22*d*. The high-pressure lubricant may exit the recess 96*d* and enter the lubricant recess 130*d*, in the manner described above with respect to the lubricant recess 130 of the third configuration (FIGS. 8-12).

Upon further rotation of the driveshaft 16, and orbital movement of the orbiting scroll member 22*d*, the high-pressure lubricant disposed in the lubricant recess 130*d* may be exposed to the channel 136 formed in the non-orbiting scroll member 24*d*. Specifically, as the orbiting scroll member 22*d* orbits about the axis 92, the lubricant recess 130*d* will align with, and be exposed to, the channel 136. The lubricant may enter the first end 138 of the channel 136, and thereafter traverse the length of the channel 136 between the first and second ends 138, 140. Specifically, the second end 140 of the channel 136 may be intermittently exposed to the low-pressure zone 71 when the orbiting scroll member 22*d* orbits relative to the non-orbiting scroll member 24*d*. The high-pressure lubricant may exit the second end 140 of the channel 136 and enter the low-pressure zone 71 due to the pressure differential therebetween. Once the lubricant has entered the low-pressure zone 71, it will undergo the compression process created by the orbital movement of the wrap 64 relative to the wrap 68, and then exit the discharge passage 70 in the high-pressure zone 73, in the manner described above with respect to the third configuration (FIGS. 8-12).

The foregoing process will repeat as the compressor 10 operates and the orbiting scroll member 22*d* orbits relative to the non-orbiting scroll member 24*d*. In this manner, a specific amount of lubrication is provided between the wraps 64, 68 of the orbiting scroll member 22*d* and non-orbiting scroll member 24*d* to reduce frictional forces and dissipate any heat that is created by such forces.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell;

a main bearing housing disposed within said shell;

a driveshaft supported by said main bearing housing;

a non-orbiting scroll member coupled to said main bearing housing and having a first surface defining a first lubricant recess; and an orbiting scroll member rotatably coupled to said driveshaft and meshingly engaged with said non-orbiting scroll member, said orbiting scroll member including a second lubricant recess and a lubricant supply path that is fluidly isolated from said second lubricant recess, said orbiting scroll member movable between a first position in which said second lubricant recess is in fluid communication with said first lubricant recess and a second position in which said second lubricant recess is fluidly isolated from said first lubricant recess.

2. The compressor of claim 1, wherein said second lubricant recess is moved between said first position and said second position based on a relative position of said orbiting scroll member and said non-orbiting scroll member.

3. The compressor of claim 2, wherein said relative position of said orbiting scroll member and said non-orbiting scroll member is based on rotation of said driveshaft.

4. The compressor of claim 1, wherein said lubricant supply path fluidly coupling said first lubricant recess to a lubricant source.

5. The compressor of claim 4, wherein said lubricant supply path is formed in said orbiting scroll member.

6. The compressor of claim 4, wherein said lubricant supply path is substantially perpendicular to a longitudinal axis of said driveshaft.

7. The compressor of claim 1, wherein said second lubricant recess is operable to fluidly communicate with at least one compression pocket formed between said non-orbiting scroll member and said orbiting scroll member.

8. The compressor of claim 1, wherein said second lubricant recess is operable to fluidly communicate with a low-pressure zone compression pocket formed between said non-orbiting scroll member and said orbiting scroll member.

9. The compressor of claim 8, wherein said second lubricant recess is in fluid communication with said first lubricant recess and said low-pressure zone compression pocket when said orbiting scroll member is in said first position.

10. The compressor of claim 9, wherein a pressure differential between said second lubricant recess and said low-pressure zone compression pocket causes lubricant in said second lubricant recess to enter said low-pressure zone compression pocket.

11. The compressor of claim 1, wherein said first surface of said non-orbiting scroll member includes a channel operable to selectively place said second lubricant recess in fluid communication with compression pockets formed between said non-orbiting scroll member and said orbiting scroll member.

12. The compressor of claim 11, wherein said channel includes an arcuate shape.

13. The compressor of claim 11, wherein a first end of said channel is adjacent to said first lubricant recess and a second end of said channel is adjacent to an outer end of a wrap of said non-orbiting scroll member.

14. The compressor of claim 13, wherein said second lubricant recess is operable to fluidly communicate with said first end of said channel, and wherein said second end of said channel is operable to fluidly communicate with a low-pressure zone compression pocket.

15. The compressor of claim 14, wherein a pressure differential between said second end of said channel and said low-pressure zone compression pocket causes lubricant in said second end to enter said low-pressure zone compression pocket.

16. The compressor of claim 15, wherein said channel includes an arcuate shape.

17. A compressor comprising:

a shell;

a main bearing housing disposed within said shell;

a driveshaft supported by said main bearing housing;

a non-orbiting scroll member coupled to said main bearing housing and having a first surface defining a first lubricant recess; and an orbiting scroll member rotatably coupled to said driveshaft and meshingly engaged with said non-orbiting scroll member to form compression pockets, said orbiting scroll member including a second lubricant recess and movable between a first position in which said second lubricant recess is in fluid communication with said first lubricant recess and one of said compression pockets, and a second position in which said second lubricant recess is fluidly isolated from said first lubricant recess and in fluid communication with said one of said compression pockets.

18. The compressor of claim 17, wherein said one of said compression pockets is in a low-pressure zone.

19. The compressor of claim 17, further comprising a lubricant supply path fluidly coupling said second lubricant recess to a lubricant source.

20. The compressor of claim 19, wherein said lubricant supply path is formed in said orbiting scroll member.

* * * * *